US005479809A

United States Patent [19]

Stachuletz et al.

[11] Patent Number: 5,479,809

[45] Date of Patent: Jan. 2, 1996

[54] APPARATUS FOR ADJUSTING THE UPPER EDGE OF A WORK ROLL TO THE ROLLING LINE

[75] Inventors: Manfred Stachuletz; Helmut Strohmeyer, both of Düsseldorf, Germany

[73] Assignee: Mannesmann Aktiengesellschaft, Düsseldorf, Germany

[21] Appl. No.: 231,436

[22] Filed: Apr. 19, 1994

Related U.S. Application Data

[63] Continuation of Ser. No. 881,026, May 11, 1992, abandoned.

[30] Foreign Application Priority Data

May 13, 1991 [DE] Germany ..... 41 15 958.6

[51] Int. Cl.[6] ..... B21B 31/30

[52] U.S. Cl. ..... 72/244

[58] Field of Search ..... 72/244, 247, 237, 72/248

[56] References Cited

U.S. PATENT DOCUMENTS

| | | | |
|---|---|---|---|
| 1,762,292 | 6/1930 | George | 72/244 |
| 4,237,715 | 12/1980 | Lutz | 72/244 |
| 4,751,837 | 6/1988 | Bohnenkamp | 72/244 |

FOREIGN PATENT DOCUMENTS

| | | | |
|---|---|---|---|
| 735346 | 5/1980 | U.S.S.R. | 72/244 |
| 1439005 | 6/1976 | United Kingdom | 72/244 |

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

The present invention relates to an apparatus for adjusting the upper edge of a lower work roll of a four high rolling stand to the rolling line. In particular, the apparatus has a horizontally displacable lower wedge element having a stepped sloped upper surface and a vertically displacable upper wedge element positioned underneath the chock of the lower back-up roll. This upper wedge element has a stepped sloped lower surface corresponding to and resting on the stepped sloped upper surface of said lower wedge element. A lift device is used for lifting the upper wedge element and the chock along the vertical axis so that the lower wedge element can be horizontally positioned. Thereafter, the upper wedge element and the chock are lowered onto the lower wedge element, thereby adjusting the upper edge of the lower roll in the roll stand to the roll line. Preferably, a cross member is positioned between the vertically displacable upper wedge element and the chock with the lift device being attached to the cross member. Thus, the cross member, the upper wedge element and the chock can all be moved along vertical axis. By the use of an I-shaped cross member, lift devices such as hydraulic piston cylinder units, can be positioned outside the path of displacement of the lower wedge elements.

9 Claims, 3 Drawing Sheets

APPARATUS FOR ADJUSTING THE UPPER EDGE OF A WORK ROLL TO THE ROLLING LINE

FIELD OF THE INVENTION

This is a continuation of U.S. application Ser. No. 07/881,026, filed May 11, 1992, now abandoned.

The present invention relates to an apparatus for adapting the upper edge of a lower work roll of a four high rolling stand to the rolling line and, particularly, to an apparatus having a pair of corresponding stepped lower and upper wedge elements below each lower roll chock, the lower wedge element being horizontally displaceable along the axis of the lower back-up roll and the upper wedge element being displaceable only in a vertical direction.

BACKGROUND AND SUMMARY OF THE INVENTION

Devices for adjusting the upper edge of a lower work roll to a roll line are known. For example, it is known to adjust the upper edge of the work rolls to the rolling line by the use of adaptor plates of varying heights. These adaptor plates, which are moved in and out by a carriage together with the roll chocks, are selected in accordance with the amount of height adjustment that is necessary in each particular case. However, this solution is not particularly advantageous, since two special adaptor plates are required for each height adjustment with the adaptor plates for large height adjustments being difficult to handle.

From Federal Republic of Germany Patent No. 28 06 525 A1, a device is known for selectively introducing fitting pieces of different height included in a removing frame below the roll chocks into the housing openings of a four-high stand for adjusting the upper edge of the work roll. For this purpose, traverse cylinders are arranged in the housings in order to lift the roll chocks so that the appropriate height fitting piece segment may be positioned underneath the roll chock. However, these cylinders necessitate expensive machining of the housings.

European Patent No. 02 31 445 discloses a device for the vertical displacement of rolls in a roll stand having fitting pieces of different height and a pair of wedges arranged below each roll chock of the back-up roll. Accordingly, by use of the pair of wedges, the height of the roll can be continuously adjusted with the lower wedge being displaceable in a horizontal direction and the upper wedge being displaceable in a vertical direction. In this prior art reference, one of several differing height fitting pieces is inserted between the upper wedge and the bottom of the chock of the roll. These fitting pieces are moved into the working position, one after the other by transverse displacement. In this way, as described in this reference, a stepwise compensation of the position of the work roll can be effected by the insertion of one of the differing height fitting pieces, with the wedges serving to bridge the differences in height between steps.

As a result of the arrangement of the displaceable fitting pieces and wedges alongside each other, this device is very expensive to construct. Furthermore, the arrangement of this device requires sufficient space in order to provide for the insertion of the different stepped fitting pieces under the work roll.

In order to overcome the disadvantages of the prior art, and in particular European Patent No. 02 31 445, the object of the present invention is to simplify this device in order to provide a simple, space-saving arrangement, so that the upper edge of the lower work roll can be precisely positioned to the rolling line.

In order to achieve this object and in accordance with the invention, each upper wedge element is adapted to be raised and lowered by a lift device together with the corresponding roll chock. Additionally, the wedge surfaces of both corresponding wedges are ratcheted or stepped with the ratchets or steps engaging each other so that the wedge elements are vertically supporting.

One aspect of the present invention resides in connecting the upper wedge element itself, on the one hand, with the lift element for the chock of the roll to be lifted and, on the other hand, simultaneously utilizing the wedge element for supporting the chock in the desired vertical position. By lifting the upper wedge element itself and the roll chock away from the lower wedge element, it is possible to shift the lower wedge element into the position desired in each case and then lower the upper wedge element and roll chock onto it. In order for the wedges to self-lock, the wedge surfaces are constructed in a stepped or ratcheted shape. In this way, the wedges can be made very short, as a result of which the path of displacement can be kept extremely short. Thus, an extremely simple, as well as strong, device is created which can be arranged in a small space within the roll stand.

In accordance with another feature of the present invention, the upper wedge element is part of a cross member which extends over the lower wedge element. The cross member, which is preferably I-shaped, can then be raised and lowered by piston-cylinder units arranged laterally along the lower wedge element. Accordingly, the corresponding upper wedge element and the cross member are guided in a vertical direction to a position above the desired height. The use of such a cross member permits the use of a piston-cylinder lift device positioned outside of the path of displacement of the lower wedge elements. These piston-cylinder units can, for instance, be flanged onto the side of the roll housings. In addition, the piston-cylinder units are readily visible for inspection. Additionally, the corresponding roll chock rests on the cross members, on the lower side of which the upper wedge element is provided.

In accordance with another feature of the present invention, the guide for the cross member consist of at least two guide bolts which are surrounded by corresponding vertical holes in the cross member.

These guides ensure that the upper wedge element is freely movable solely in the vertical direction. The guide bolts and corresponding holes are simple structural elements which fully satisfy the requirements present here.

Additionally, it has been found that favorable support conditions are obtained if the ratio of the horizontal length to the vertical length of the steps ranges from about 2:1 to about 3:1. Moreover, the height and number of the steps are selected in accordance with the requirements of the displaceability of the work rolls, with the rule that, generally, a finer adaptation to the vertical position can be effected with a plurality of small steps rather than with only a few high steps.

BRIEF DESCRIPTION OF THE DRAWINGS

The present invention is explained in further detail with reference to the drawings in which.

For convenience of reference, like components, structural elements and features in the various figures are designated by like reference numerals.

DETAILED DESCRIPTION OF THE PRESENTLY PREFERRED EMBODIMENTS

Figure 1:
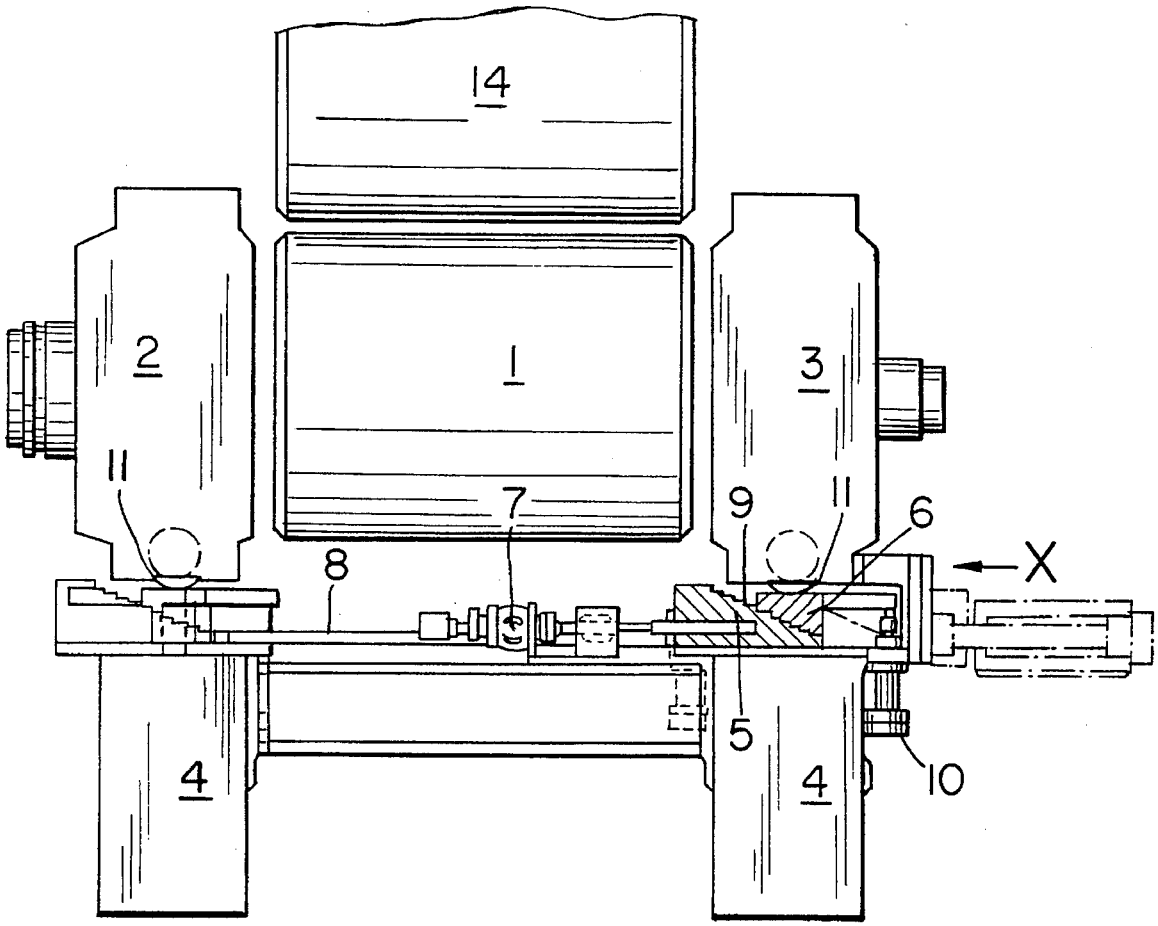
FIG. 1 is a partial cross-sectional view of the adaptor device of the present invention.

FIG. 1 shows a cross-sectional view of a lower back-up roll 1 and a lower work roll 14 of a four-high roll stand, which is otherwise not shown. The back-up roll 1 is mounted on left and right roll chocks 2, 3 positioned on both sides of the lower back-up roll 1. The roll chocks 2, 3 are capable of being raised and lowered with respect to the roll housing 4.

Figure 4:
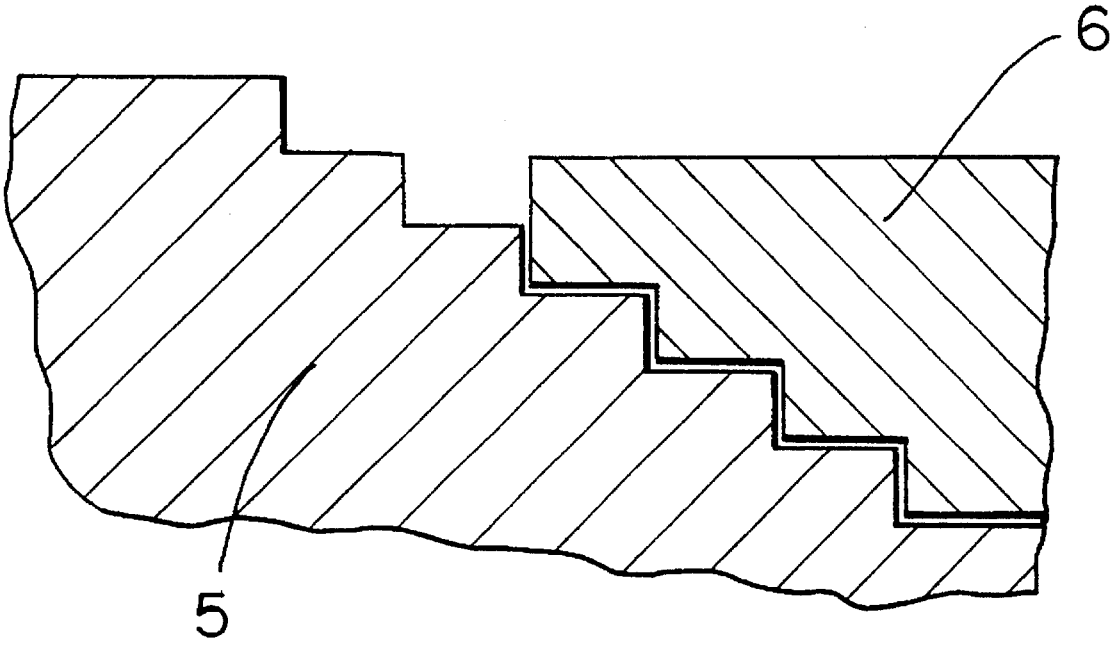
FIG. 4 is a partial cross-sectional view of the corresponding upper and lower wedge elements of the present invention.

The apparatus of the present invention for adapting the upper edge of the lower work roll 14 to the roll line, consists primarily of a lower wedge element 5 and an upper wedge element 6, one pair of which are shown in FIG. 1. Both lower and upper wedge elements 5, 6 are provided with corresponding small steps or ratchets as schematically shown in FIG. 4. These ratchets replace the flat wedge surfaces customary in other prior art wedges. Accordingly, the steps or ratchets on both wedges 5, 6, are identically constructed so that the rachets of the upper wedge element 6 rest securely on the corresponding ratchets of the lower wedge element 5. Accordingly, the upper wedge element 6 can take up large horizontal forces.

Additionally, each lower wedge element 5 is displaceable by means of a drive 7 in a horizontal direction parallel to the axial direction of the lower back-up roll 1. The two lower wedge elements 5 are preferably connected with each other via traction elements 8 for simultaneously movement of the wedge elements under both roll chocks 2, 3.

Figure 2:
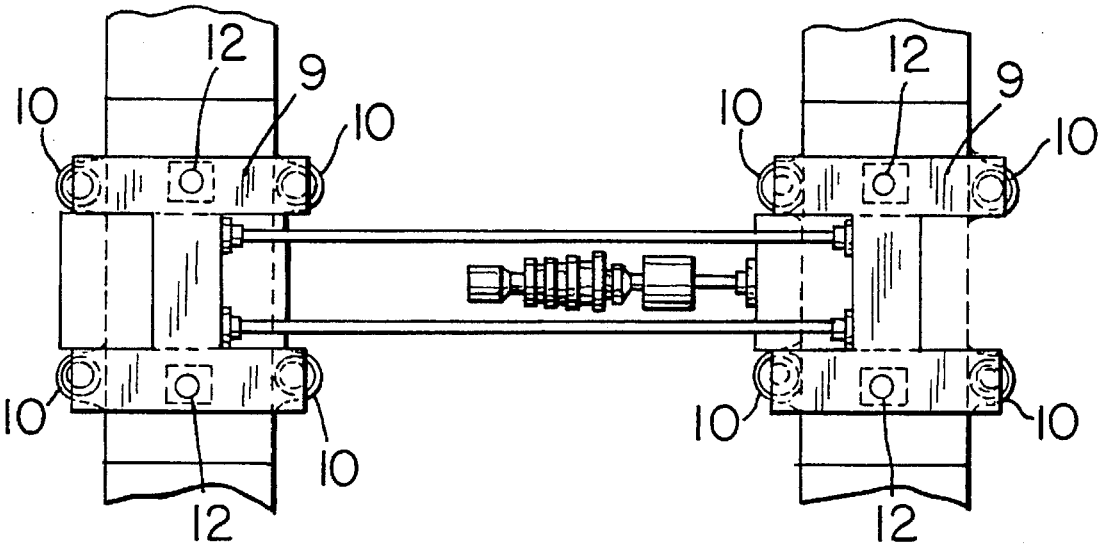
FIG. 2 is a top view of the adaptor device of the present invention.

Each upper wedge element 6 is positioned on the bottom of a respective cross member 9 the shape of which can be clearly noted from the top view of FIG. 2. The cross members 9 on both sides of the roll stand extend beyond each lower wedge element 5. Both cross members are identical in dimension and consist of an I-shaped body as seen from a top view. On the outer ends of the I-shaped cross member 9, four piston-cylinder units 10 are arranged. Each cross member 9, together with the roll chocks 2, 3 seated on it at 11 and the upper wedge element 6, can be raised.

Once the cross member 9 together with the upper wedge element 6 is raised, the lower wedge elements 5 can now be positioned by transverse displacement by means of the drive 7. Thereafter, the cross member 9 together with the upper wedge element 6 and the back-up roll chocks 2,3 can be lowered so that the vertical position or height of the lower back-up roll 1 and of the work roll 14 arranged above it can be varied.

In order to prevent the cross members 9 and the upper wedge elements 6 from changing their position with respect to the roll chocks 2 and 3 upon displacement of the lower wedge elements 5, guide bolts 12 are provided. These vertical extending bolts 12 pass through corresponding holes in the cross members 9 to the lower roll housing 4. Accordingly, the guide bolts 12 and holes permit only vertical movement of both the cross member 9 and the upper wedge elements 6.

Figure 3:
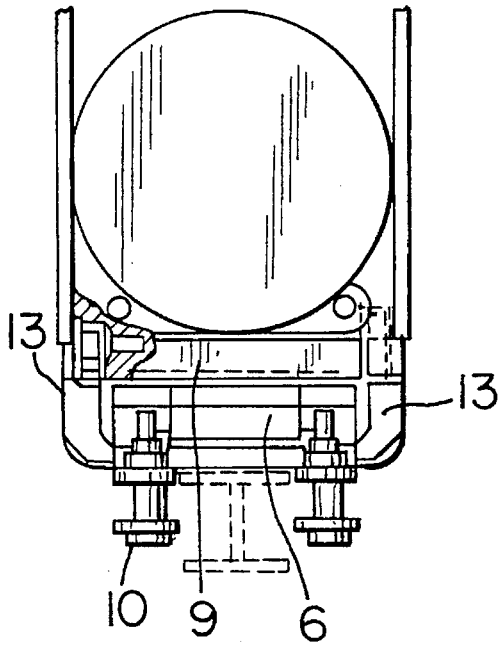
FIG. 3 is a side view of the adaptor device of the present invention as seen in the X direction of FIG. 1.

FIG. 3 shows the arrangement of the piston-cylinder units 10 with respect to the cross member 9. The piston-cylinder units 10 do not interfere with the path of movement of the lower wedge elements 5, since the piston-cylinder units 10 are disposed laterally adjacent the lower wedge elements 5.

As also shown in FIG. 3, rails 13 are provided for the removal of the roll set by the use of wheel sets provided on the lower roll chocks 2, 3 as shown in FIGS. 2 and 3. These rails 13 run laterally alongside the device of the invention.

It should be understood that the preferred embodiments and examples described are for illustrative purposes only and are not to be construed as limiting the scope of the present invention which is properly delineated only in the appended claims.

What is claimed is:

1. An apparatus for vertically adjusting a lower roll in a roll stand having a plurality of chocks, said apparatus comprising:

a wedge element disposed supportingly beneath each said chock and adjustable for vertically adjusting the lower roll, each said wedge element comprising an upper wedge and a lower wedge, and each of said upper and lower wedges having a sloped surface for load-bearing engagement with the sloped surface of the other of said upper and lower wedges when said upper wedge is vertically supported atop said lower wedge; and lifting means connected to said upper wedge and operable for vertically moving the upper wedge independently of the lower wedge, each said sloped surface being defined by a plurality of steps extending along said sloped surface, and each said step of each of the upper and lower wedges comprising a substantially horizontally-oriented surface engageable in load bearing relation with a substantially horizontally-oriented surface of a step of the other of said upper and lower wedges when said upper wedge is disposed in vertically supported relation atop said lower wedge, said lower wedge being disposed for substantially horizontal movement relative to said upper wedge to provide adjustability of the lower roll to a new vertical position by operation of said lifting means to vertically move the upper wedge combined with relative horizontal movement of said lower wedge so as to place said substantially horizontal surfaces of a plurality of said steps of said upper and lower wedges in load-bearing contact to support said upper wedge atop said lower wedge in the new vertical position of the lower roll.

2. The apparatus according to claim 1, wherein said lifting means includes a hydraulic piston cylinder unit.

3. The apparatus according to claim 1, wherein each step of said stepped sloped upper surface of said lower wedge has a horizontal length and a vertical length, said horizontal length and said vertical length having a ratio of about 2 to 1.

4. The apparatus according to claim 1, wherein each step of said stepped sloped upper surface of said lower wedge has a horizontal length and a vertical length, said horizontal length and said vertical length having a ratio of about 3 to 1.

5. The apparatus according to claim 1, wherein the sloped surfaces each have a length, the sloped surfaces being stepped along their entire respective lengths.

6. The apparatus according to claim 1, further comprising a vertically displaceable cross member (9) positioned between said vertically displaceable upper wedge and the associated supported chock, said lifting means being attached to said cross member (9) for lifting said cross member (9), said upper wedge and the associated supported chock along a vertical axis.

7. The apparatus according to claim 6, wherein said lifting means includes hydraulic piston cylinder units arranged laterally alongside said horizontally displaceable lower wedge.

8. The apparatus according to claim 6, further comprising means for guiding said vertically displaceable cross member (9), said cross member (9) having guide holes therein.

9. The apparatus according to claim 8, wherein said means for guiding said cross member comprises guide bolts (12) extending through said guide holes of said cross member (9).

* * * * *